US008196708B2

(12) United States Patent
Kung

(10) Patent No.: US 8,196,708 B2
(45) Date of Patent: Jun. 12, 2012

(54) LUBRICANT CIRCULATION SYSTEM

(76) Inventor: Chang Cheng Kung, Kaohsiung (TW)

( * ) Notice: Subject to any disclaimer, the term of this patent is extended or adjusted under 35 U.S.C. 154(b) by 641 days.

(21) Appl. No.: 12/394,134

(22) Filed: Feb. 27, 2009

(65) Prior Publication Data

US 2010/0158736 A1 Jun. 24, 2010

(30) Foreign Application Priority Data

Dec. 23, 2008 (TW) ..... 97150333 A

(51) Int. Cl.

| | |
|---|---|
| ***F01M 5/00*** | (2006.01) |
| ***F16N 7/36*** | (2006.01) |
| ***F16N 7/14*** | (2006.01) |
| ***F16N 13/10*** | (2006.01) |
| ***F16N 11/10*** | (2006.01) |
| ***F16N 13/16*** | (2006.01) |
| ***F16N 9/04*** | (2006.01) |
| ***F16N 13/02*** | (2006.01) |
| ***F16N 13/20*** | (2006.01) |
| ***F16N 25/02*** | (2006.01) |

(52) U.S. Cl. ..... 184/6.22; 184/27.4; 184/29; 184/32; 184/34

(58) Field of Classification Search ..... 184/6.22, 184/27.4, 29, 32, 34; 417/98, 395, 384, 385, 417/383, 388; 165/165

See application file for complete search history.

(56) References Cited

U.S. PATENT DOCUMENTS

| | | | | | |
|---|---|---|---|---|---|
| 715,717 | A | * | 12/1902 | Whitaker | 184/40 |
| 891,774 | A | * | 6/1908 | Hutchings | 184/55.1 |
| 1,182,777 | A | * | 5/1916 | Lavoo | 184/24 |
| 1,426,381 | A | * | 8/1922 | Hecker | 165/165 |
| 1,535,722 | A | * | 4/1925 | Good | 165/165 |
| 1,571,068 | A | * | 1/1926 | Stancliffe | 165/165 |
| 1,687,236 | A | * | 10/1928 | Buffington | 165/165 |
| 1,788,886 | A | * | 1/1931 | Nutt | 417/388 |
| 1,860,731 | A | * | 5/1932 | Cole | 184/6.22 |
| 1,876,708 | A | * | 9/1932 | MacPherson | 184/6.22 |
| 1,904,412 | A | * | 4/1933 | Clouse | 184/6.22 |
| 1,910,375 | A | * | 5/1933 | Woolson | 184/6 |
| 1,942,101 | A | * | 1/1934 | Howarth | 384/316 |
| 1,948,929 | A | * | 2/1934 | MacPherson | 184/6.22 |
| 1,958,899 | A | * | 5/1934 | MacAdams | 165/146 |
| 2,017,847 | A | * | 10/1935 | Bijur | 184/7.3 |
| 2,042,860 | A | * | 6/1936 | Peabody et al. | 137/13 |
| 2,051,026 | A | * | 8/1936 | Booth | 184/104.3 |

(Continued)

*Primary Examiner* — Michael Mansen
*Assistant Examiner* — Henry Liu
(74) *Attorney, Agent, or Firm* — Alan Kamrath; Kamrath IP Lawfirm, PA

(57) ABSTRACT

A lubricant circulation system (10) includes a lubricant supply cup (1) containing a lubricant (6) and having an oil return hole (13) connected to an oil return pipe (16) of a rotary equipment (5). A pump seat (2) is coupled to the lubricant supply cup (1) and includes a pump chamber (253) and a pump outlet (254) connected to an oil supply pipe (256) of the rotary equipment (5). The lubricant (6) in the lubricant supply cup (1) flows into the pump chamber (253). A pump body (3) is coupled to the pump seat (2) and includes a pressure chamber (34) having a pressure inlet (341) and a pressure outlet (342) with a pressure relief valve (35). By introducing a pressurized fluid (7) from the pressure inlet (341) into the pressure chamber (34), a piston rod (27) in the pump chamber (253) reciprocally moves to allow the lubricant (6) in the pump chamber (253) to be successively supplied to the rotary equipment (5). A cooling device (4) is provided on the lubricant supply cup (1) for cooling the lubricant (6) before it enters the rotary equipment (5).

4 Claims, 9 Drawing Sheets

U.S. PATENT DOCUMENTS 2,140,735 A * 12/1938 Clarke et al. ..... 184/104.1
2,164,273 A * 6/1939 Hodson ..... 184/29
2,264,820 A * 12/1941 Young ..... 165/82
2,320,140 A * 5/1943 Kocher ..... 184/27.1
2,332,882 A * 10/1943 Abbatiello ..... 165/301
2,359,448 A * 10/1944 Shaw ..... 165/297
2,673,571 A * 3/1954 Lerom ..... 137/590
2,680,433 A * 6/1954 De Padova et al. ..... 123/196 AB
2,879,050 A * 3/1959 Folger ..... 165/81
2,887,304 A * 5/1959 Hilliard ..... 165/165
2,996,149 A * 8/1961 Walker ..... 184/27.4
3,042,147 A * 7/1962 Hutchings ..... 184/6.22
3,065,703 A * 11/1962 Harman ..... 417/341
3,080,716 A * 3/1963 Cummings et al. ..... 60/736
3,090,365 A * 5/1963 Constantino ..... 123/41.08
3,161,234 A * 12/1964 Rannenberg ..... 165/163
3,170,406 A * 2/1965 Robertson ..... 417/364
3,253,651 A * 5/1966 Larson ..... 165/122
3,256,957 A * 6/1966 Miller ..... 184/6.22
3,283,722 A * 11/1966 Helms ..... 417/349
3,399,708 A * 9/1968 Usher et al. ..... 159/28.1
3,407,876 A * 10/1968 Richardson ..... 165/179
3,451,214 A * 6/1969 Bradley ..... 60/788
3,508,845 A * 4/1970 Strassburger ..... 417/32
3,658,153 A * 4/1972 Berman ..... 184/6.3
3,693,757 A * 9/1972 Callahan et al. ..... 184/7.4
3,729,064 A * 4/1973 Wolf et al. ..... 184/6.14
3,800,830 A * 4/1974 Etter ..... 137/625.41
4,002,224 A * 1/1977 Easter ..... 184/6.11
4,027,643 A * 6/1977 Feenan et al. ..... 123/196 AB
4,066,869 A * 1/1978 Apaloo et al. ..... 219/490
4,068,982 A * 1/1978 Quarve ..... 417/387
4,074,752 A * 2/1978 Schlosberg ..... 165/96
4,095,644 A * 6/1978 Huff ..... 165/299
4,114,571 A * 9/1978 Ruf ..... 123/41.35
4,153,140 A * 5/1979 Mahr et al. ..... 184/6
4,156,625 A * 5/1979 Wachendorfer, Sr. ..... 156/245
4,265,600 A * 5/1981 Mandroian ..... 417/379
4,324,213 A * 4/1982 Kasting et al. ..... 123/196 A
4,333,522 A * 6/1982 Brune ..... 165/69
4,343,988 A * 8/1982 Roller et al. ..... 392/467
4,363,216 A * 12/1982 Bronicki ..... 60/657
4,414,861 A * 11/1983 Witt ..... 74/606 A
4,430,048 A * 2/1984 Fritsch ..... 417/383
4,475,876 A * 10/1984 Olen ..... 418/84
4,498,525 A * 2/1985 Smith ..... 165/287
4,546,827 A * 10/1985 Wachendorfer, Sr. ..... 165/165
4,556,024 A * 12/1985 King et al. ..... 123/196 AB
4,564,084 A * 1/1986 Heckel ..... 184/6.11
4,622,817 A * 11/1986 Kobayashi ..... 60/608
4,739,862 A * 4/1988 Mullis ..... 184/6.22
4,789,585 A * 12/1988 Saito et al. ..... 428/185
4,807,342 A * 2/1989 Lapeyre ..... 29/890.03
4,872,502 A * 10/1989 Holzman ..... 165/299
4,878,536 A * 11/1989 Stenlund ..... 165/119
4,895,220 A * 1/1990 Abraham et al. ..... 184/6.4
4,923,001 A * 5/1990 Marcolin ..... 165/140
4,955,953 A * 9/1990 Kayser ..... 184/42
4,957,187 A * 9/1990 Burgess ..... 184/6.12
5,002,156 A * 3/1991 Gaunt ..... 184/39.1
5,072,784 A * 12/1991 Stenlund ..... 165/47
5,080,196 A * 1/1992 Bignall ..... 184/15.1
5,101,885 A * 4/1992 Drake ..... 165/47
5,107,960 A * 4/1992 Below ..... 184/6.16
5,110,460 A * 5/1992 Gilas ..... 210/149
5,163,534 A * 11/1992 Hillman ..... 184/27.1
5,217,085 A * 6/1993 Barrie et al. ..... 184/104.1
5,282,507 A * 2/1994 Tongu et al. ..... 165/165
5,285,871 A * 2/1994 Sievenpiper ..... 184/7.4
5,301,642 A * 4/1994 Matsushiro et al. ..... 123/196 AB
5,341,900 A * 8/1994 Hikes ..... 184/6.12
5,485,895 A * 1/1996 Peterson et al. ..... 184/6.22
5,495,917 A * 3/1996 Pax ..... 184/7.4
5,549,177 A * 8/1996 Hosokawa et al. ..... 184/6.22
5,568,842 A * 10/1996 Otani ..... 184/6.22
5,570,868 A * 11/1996 Flaming ..... 251/14
5,667,037 A * 9/1997 Orlitzky ..... 184/39
5,707,219 A * 1/1998 Powers ..... 417/386
5,769,182 A * 6/1998 Parenteau ..... 184/6.4
5,832,992 A * 11/1998 Van Andel ..... 165/165
5,927,384 A * 7/1999 Waldner, Jr. ..... 165/47
5,954,127 A * 9/1999 Chrysler et al. ..... 165/170
5,992,515 A * 11/1999 Spiegel ..... 165/283
6,012,903 A * 1/2000 Boelkins ..... 417/63
6,034,872 A * 3/2000 Chrysler et al. ..... 361/699
6,085,871 A * 7/2000 Karamata ..... 184/75
6,264,003 B1 * 7/2001 Dong et al. ..... 184/104.1
6,296,078 B1 * 10/2001 Liu ..... 184/29
6,328,100 B1 * 12/2001 Haussmann ..... 165/176
6,468,056 B1 * 10/2002 Murakoshi ..... 417/395
6,481,982 B1 * 11/2002 Yokomichi ..... 417/395
6,520,293 B1 * 2/2003 Ogawa et al. ..... 184/6.22
6,695,047 B2 * 2/2004 Brocksopp ..... 165/292
6,705,432 B2 * 3/2004 Conley et al. ..... 184/7.4
6,767,189 B2 * 7/2004 Kleibrink ..... 417/53
6,899,530 B2 * 5/2005 Lehrke et al. ..... 417/395
6,913,438 B2 * 7/2005 Rockwood ..... 415/112
7,527,087 B2 * 5/2009 Desai et al. ..... 165/140
7,654,801 B2 * 2/2010 Spude ..... 417/386
7,665,974 B2 * 2/2010 Hembree ..... 417/387
7,762,238 B2 * 7/2010 Gibson et al. ..... 123/506
7,811,067 B2 * 10/2010 Dietzsch et al. ..... 417/298
2008/0273997 A1 * 11/2008 Hembree ..... 417/392

* cited by examiner

LUBRICANT CIRCULATION SYSTEM

BACKGROUND OF THE INVENTION

The present invention relates to a lubricant circulation system and, more particularly, to a lubricant circulation system for circularly supplying a cooled lubricant to a rotary equipment so as to lubricate bearings of the rotary equipment.

In rotary equipments such as pumps for delivering liquid, proper lubrication is required between a rotary shaft and shaft supporting bearings to minimize wear of a rotation interface therebetween. The lubrication further provides dissipation of heat generated by friction between the rotary shaft and the bearings. However, leakage of the lubricant is liable to occur, resulting in dry friction of the interface between the rotary shaft and the bearings and, thus, causing damage to the rotary shaft or even sparks that may lead to a fire. Further, the lubricant in the rotary equipment deteriorates due to high heat generated from the friction at the rotation interface.

To prevent the above-mentioned problems due to leakage of the lubricant, an oil cup containing a supplemental lubricant is generally mounted outside of the rotary equipment and connects a conduit to a lubricant filling inlet of the rotary equipment. Once the lubricant in the rotary equipment is below a given level, an immediate supply of the lubricant can be provided by the oil cup. However, the additional lubricant from the oil cup can not circulate in the rotary equipment and, thus, can not provide heat exchange to cool the lubricant in the rotary equipment so that the resultant lubrication effect is still unsatisfactory.

Thus, a need exists for a lubricant circulation system that can circularly supply a lubricant to a rotary equipment while providing heat exchange to cool the lubricant in the rotary equipment.

BRIEF SUMMARY OF THE INVENTION

The present invention solves this need and other problems in the field of lubricant supplement for a rotary equipment by providing, in a preferred form, a lubricant circulation system including a lubricant supply cup which includes an oil chamber containing a lubricant. The lubricant supply cup further includes an oil return hole adapted to communicate the oil chamber with an oil return pipe of a rotary equipment for returning the lubricant from the rotary equipment into the oil chamber. Further, the lubricant supply cup includes a lower portion having an oil supply outlet extending along a longitudinal axis of the lubricant supply cup. The lubricant circulation system further includes a pump seat. The pump seat includes an upper end engaged with the lower portion of the lubricant supply cup. The pump seat further includes a first side face and a second side face spaced from the first side face in a direction transverse to the longitudinal axis. The pump seat further includes a pump chamber extending from the first side face towards but spaced from the second side face and receiving a piston rod. A pump inlet is provided between an inner end of the pump chamber and the upper end of the pump seat and in communication with the oil supply outlet of the lubricant supply cup. A pump outlet is provided between the inner end of the pump chamber and the second side face and adapted to be connected to an oil supply pipe of the rotary equipment for supplying the lubricant to the rotary equipment. The lubricant circulation system further includes a pump body. The pump body includes a coupling surface engaged with the first side face of the pump seat. The pump body further includes a first side and a second side spaced from the first side and extending in a direction transverse to the coupling surface. The pump body further includes a pressure chamber extending from the first side to the second side and having a pressure inlet in the first side and a pressure outlet in the second side. A pressure relief valve is mounted in the pressure outlet for closing or opening the pressure outlet. A fluid passage is provided between the pressure chamber and the coupling surface of the pump body. The lubricant in the lubricant supply cup flows into the inner end of the pump chamber through the oil supply outlet of the lubricant supply cup and the pump inlet of the pump seat. A pressurized fluid is introduced from the pressure inlet into the pressure chamber. The pressurized fluid applies a pressure to the piston rod through the fluid passage of the pump body during closure of the pressure outlet and exits the pressure outlet when the pressure of pressurized fluid flow is greater than a pressure value so that the pressure relief valve opens the pressure outlet, reciprocating the piston rod in the pump chamber to successively supply the lubricant in the inner end of the pump chamber to the rotary equipment.

In the most preferred form, a diaphragm is provided between the coupling surface of the pump body and the first side face of the pump seat. The oil supply outlet of the lower portion of the lubricant supply cup includes a plurality of spaced, longitudinal holes each extending from a lower end face of the lubricant supply cup into the oil chamber along the longitudinal axis. The pump chamber extends in a direction perpendicular to the longitudinal axis. The lubricant supply cup further includes a first side wall and a second side wall spaced from the first side wall in a direction perpendicular to the longitudinal axis. The lower portion of the lubricant supply cup includes a plurality of cooling holes spaced from each other and each extending from the first side wall to the second side wall and not in communication with the longitudinal holes. The lubricant circulation system further includes a cooling device attached to the lower portion of the lubricant supply cup for cooling the lubricant before it flows out of the lubricant supply cup. The cooling device includes first and second cover plates respectively mounted to the first and second side walls of the lower portion of the lubricant supply cup. The first cover plate includes a coolant inlet in fluid communication with one of the cooling holes for feeding a coolant into the cooling holes. The second cover plate includes a coolant outlet in fluid communication with one of the cooling holes allowing the coolant in the cooling holes to exit the coolant outlet.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
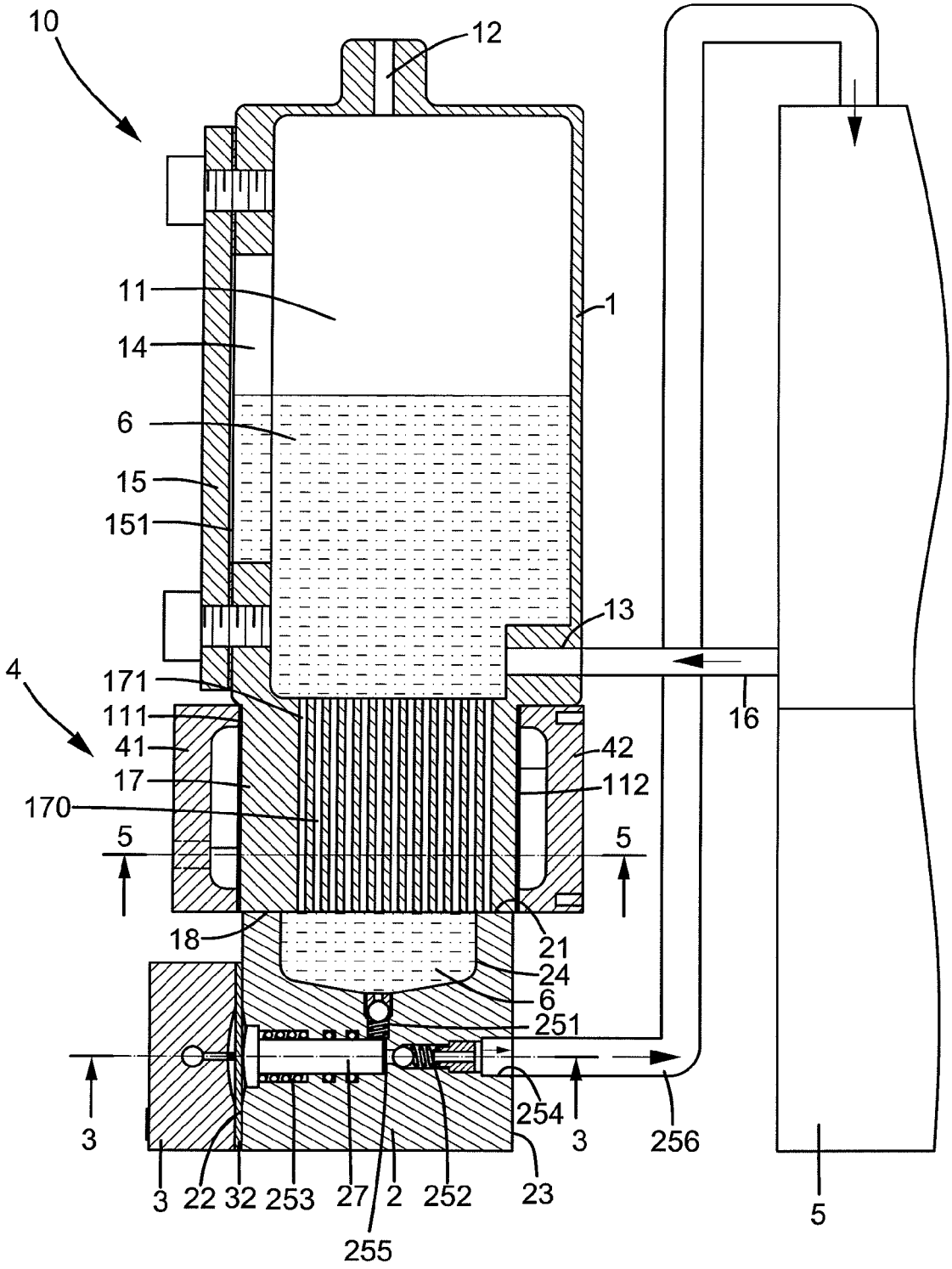
FIG. 1 shows a cross sectional view of a lubricant circulation system according to the preferred teachings of the present invention with an oil return pipe and an oil supply pipe connected between the lubricant circulation system and a rotary equipment.
Figure 2:
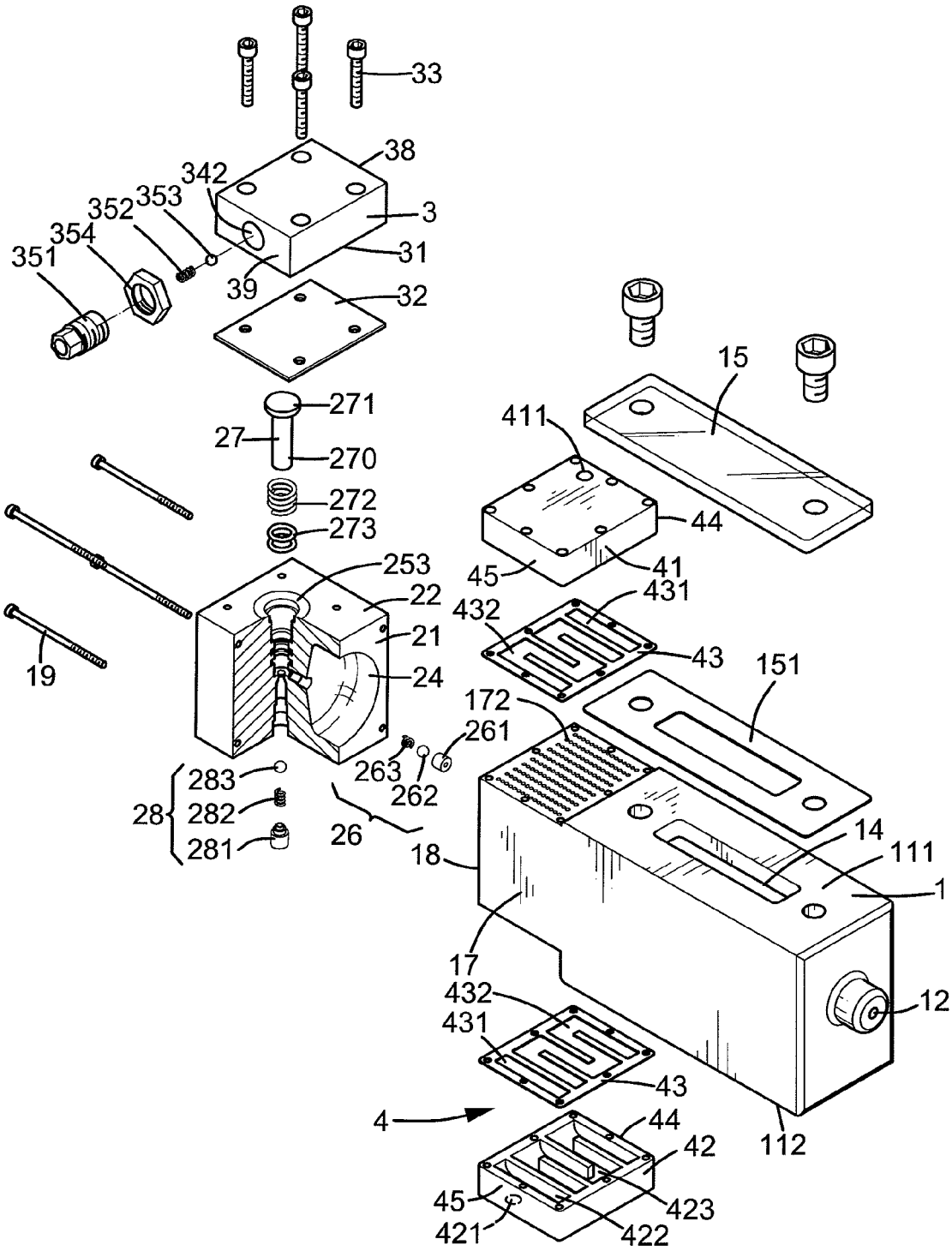
FIG. 2 shows an exploded perspective view of the lubricant circulation system of FIG. 1.

A lubricant circulation system according to the preferred teachings of the present invention is shown in the drawings and generally designated 10. According to the preferred form shown, lubricant circulation system 10 includes a lubricant supply cup 1, a pump seat 2, a pump body 3 and a cooling device 4.

Lubricant supply cup 1 includes an oil chamber 11 containing a lubricant 6. Lubricant supply cup 1 further includes an oil return hole 13 adapted to communicate oil chamber 11 with an oil return pipe 16 of a rotary equipment 5 for returning lubricant 6 from rotary equipment 5 into oil chamber 11. An oil filling hole 12 is provided in an upper end of lubricant supply cup 1 for replenishing lubricant 6 into oil chamber 11. Lubricant supply cup 1 further includes a lower portion 17 having an oil supply outlet 170 extending along a longitudinal axis of lubricant supply cup 1. According to the most preferred form shown, oil supply outlet 170 includes a plurality of spaced, longitudinal holes 171 each extending from a lower end face 18 of lubricant supply cup 1 into oil chamber 11 along the longitudinal axis. Lubricant supply cup 1 further includes a first side wall 111 and a second side wall 112 spaced from first side wall 111 in a direction perpendicular to the longitudinal axis. Lower portion 17 of lubricant supply cup 1 further includes a plurality of cooling holes 172 spaced from each other and each extending from first side wall 111 to second side wall 112 and not in communication with longitudinal holes 171 (see FIG. 5). Further, a longitudinal slot 14 is provided in first side wall 111 and covered by a washer 151 and a transparent window 15 so that the level of lubricant 6 in oil chamber 11 can be viewed through window 15.

Figure 7:
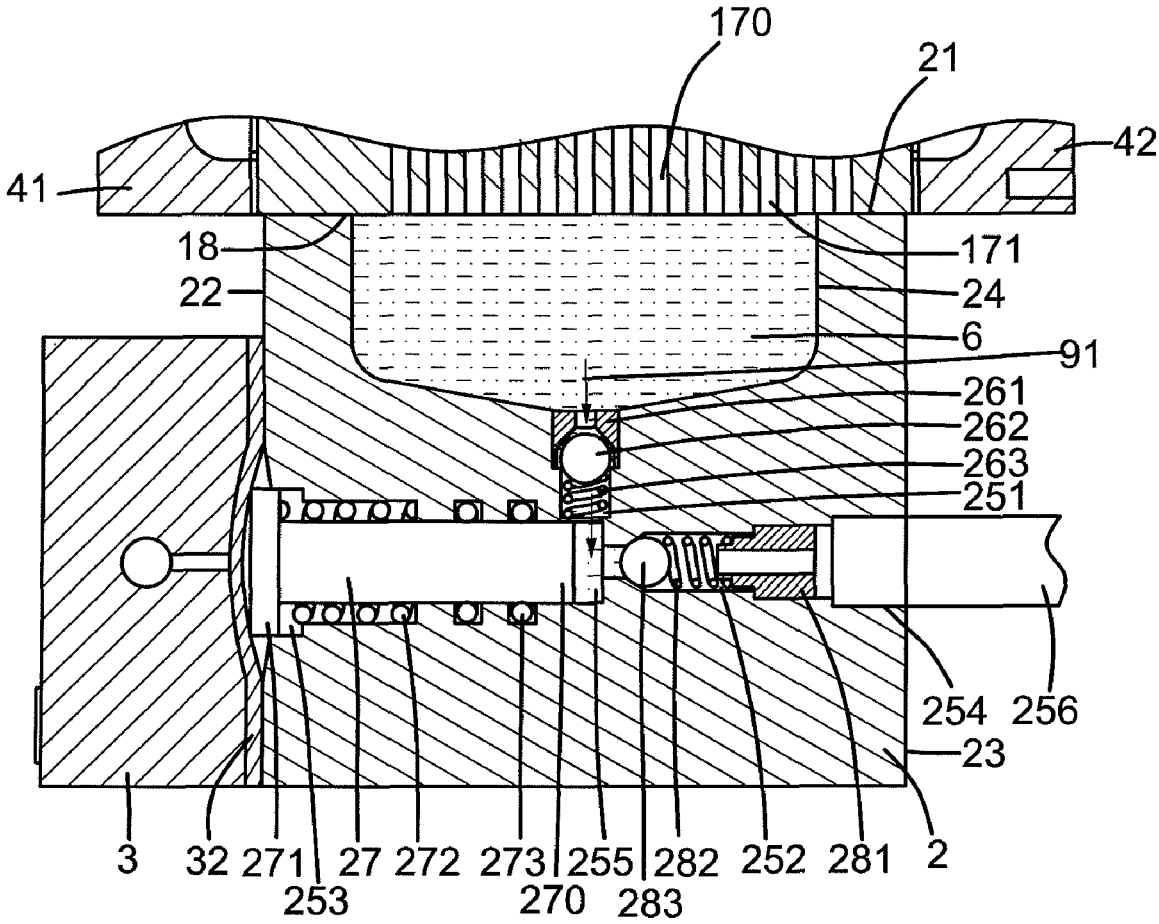
FIG. 7 shows a cross sectional view similar to FIG. 4, with the piston rod and the ball moved leftward and with another ball moves downward.

Pump seat 2 includes an upper end 21, a first side face 22, and a second side face 23 spaced from first side face 22 in a direction transverse to the longitudinal axis. Upper end 21 of pump seat 2 is engaged with lower portion 17 of lubricant supply cup 1 by a plurality of screws 19 extending through pump seat 2 into lubricant supply cup 1. Pump seat 2 further includes a pump chamber 253 extending from first side face 22 towards but spaced from second side face 23 and receiving a piston rod 27. Pump chamber 253 includes an inner end 255 in an interior of pump seat 2. A pump inlet 251 is provided between inner end 255 and upper end 21 of pump seat 2 and in communication with oil supply outlet 170 of lubricant supply cup 1. According to the preferred form shown, pump inlet 251 includes a recess 24 in upper end 21 of pump seat 2 for receiving lubricant 6 from oil supply outlet 170 of lubricant supply cup 1. Further, a first check valve 26 is mounted in pump inlet 251 and includes a valve seat 261 in pump inlet 251 and a first ball 262 biased by a first spring 263 to a normally closed position against valve seat 261, preventing lubricant 6 from flowing from inner end 255 to recess 24 (see FIG. 4). First ball 262 is moveable against first spring 263 to an open position allowing flow of lubricant 6 from recess 24 to inner end 255 of pump chamber 253 (see FIG. 7). A pump outlet 252 is provided between inner end 255 of pump chamber 253 and second side face 23 and adapted to be connected to an oil supply pipe 256 of rotary equipment 5 for supplying lubricant 6 to rotary equipment 5. A second check valve 28 is mounted in pump outlet 252 and includes a second ball 283 biased by a second spring 282 to a normally closed position against an inner end of pump outlet 252 adjacent to inner end 255 of pump chamber 253, preventing lubricant 6 from flowing from pump outlet 252 to inner end 255 (see FIG. 7). Second spring 282 is located between second ball 283 and a spring seat 281 in the pump outlet 252 so that second ball 283 is moveable against second spring 282 to an open position allowing flow of lubricant 6 from inner end 255 of pump chamber 253 to pump outlet 252 (see FIG. 4). Piston rod 27 includes a first end 271 having a piston head and adjacent to first side face 22 of pump seat 2. Piston rod 27 further includes a second end 270 adjacent to inner end 255 of pump chamber 253. A spring 272 is mounted in pump chamber 253 and abuts against and biases first end 271 of piston rod 27 towards first side face 22 of pump seat 2. Two O-rings 273 are mounted around piston rod 27 for preventing lubricant 6 in inner end 255 of pump chamber 253 from leaking through pump chamber 253.

Pump body 3 includes a coupling surface 31, a first side 38 and a second side 39 spaced from first side 38 and extending in a direction transverse to coupling surface 31. Coupling surface 31 is engaged with first side face 22 of pump seat 2 by a plurality of screws 33 extending through pump body 3 into pump seat 2. A diaphragm 32 is provided between coupling surface 31 of pump body 3 and first side face 22 of pump seat 2 and contacts first end 271 of piston rod 27. Pump body 3 further includes a pressure chamber 34 extending from first side 38 to second side 39 and having a pressure inlet 341 in first side 38 and a pressure outlet 342 in second side 39. A fluid passage 37 is provided between pressure chamber 34 and coupling surface 31 of pump body 3. According to the preferred form shown, fluid passage 37 includes a recessed portion 36 formed in coupling surface 31 and facing first end 271 of piston rod 27 so that a central portion of diaphragm 32 is flexible between recessed portion 36 and first end 271 of piston rod 27. Fluid passage 37 further includes a plurality of holes spaced from each other in a direction perpendicular to coupling surface 31 and extending between pressure chamber 34 and recessed portion 36. A pressurized fluid (indicated by arrow 7 in FIG. 3), such as water with a constant pressure of 5 kg, is introduced from pressure inlet 341 into pressure chamber 34. A pressure relief valve 35 is mounted in pressure outlet 342 of pump body 3 for closing or opening pressure outlet 342. In the preferred form shown, pressure relief valve 35 includes a valve seat 351 engaged in pressure outlet 342, and a ball 353 biased by a spring 352 located between ball 353 and valve seat 351 to a normally closed position against an inner end of pressure outlet 342 to close pressure outlet 342. Ball 353 in pressure outlet 342 is moved against spring 352 to an open position opening pressure outlet 342 when the pressure of pressurized fluid 7 in pressure chamber 34 is greater than the biasing force of spring 352 to ball 353, allowing pressurized fluid 7 to exit pressure outlet 342. In the preferred form shown, valve seat 351 is threadedly coupled in pressure outlet 342 and positioned by a nut 354 outside of pressure outlet 342 so that the position of valve seat 351 in pressure outlet 342 is adjustable by rotating nut 354 to change the biasing force of spring 352 to ball 353.

Figure 5:
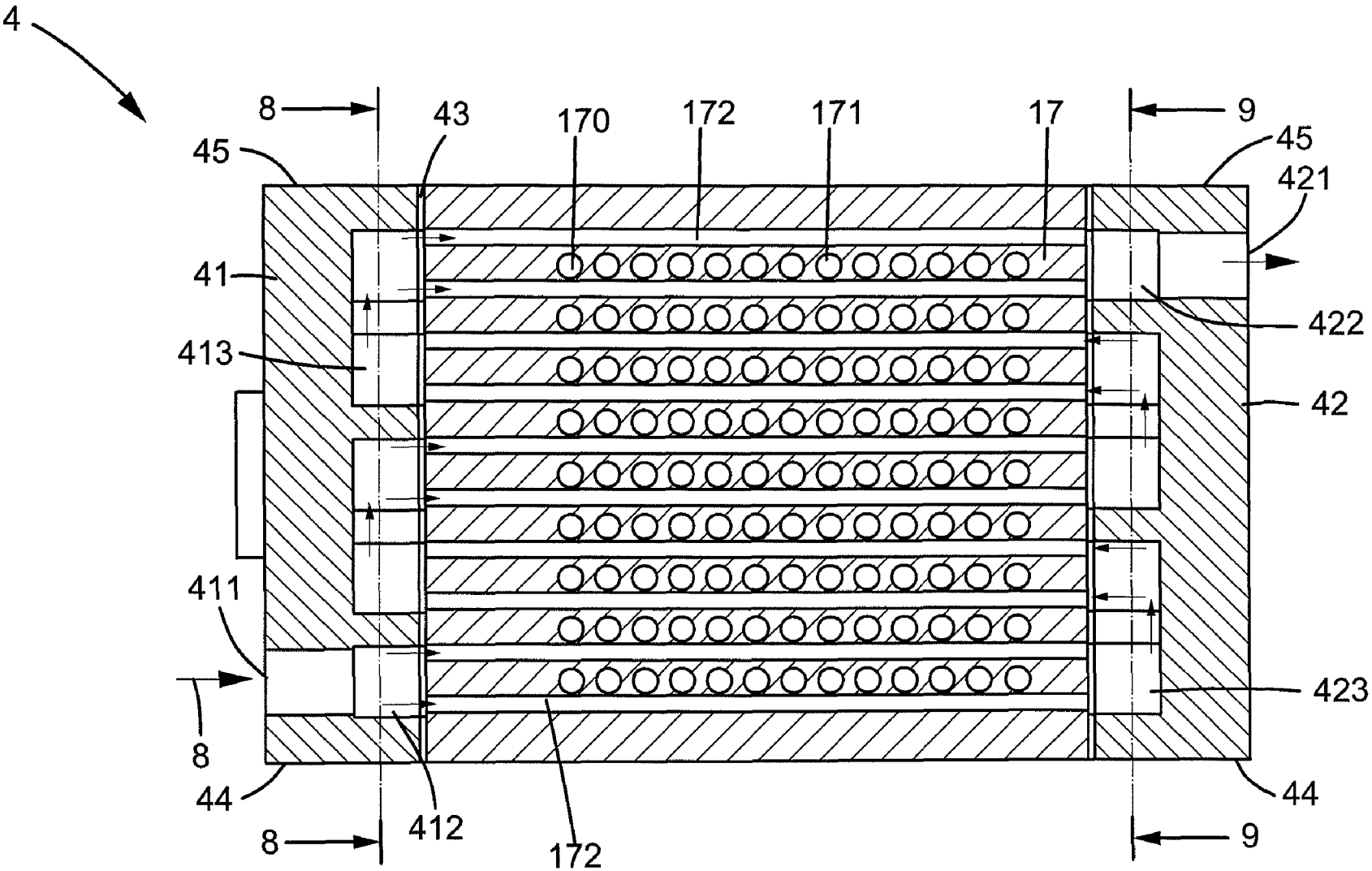
FIG. 5 is a cross sectional view taken along section line 5-5 of FIG. 1.
Figure 8:
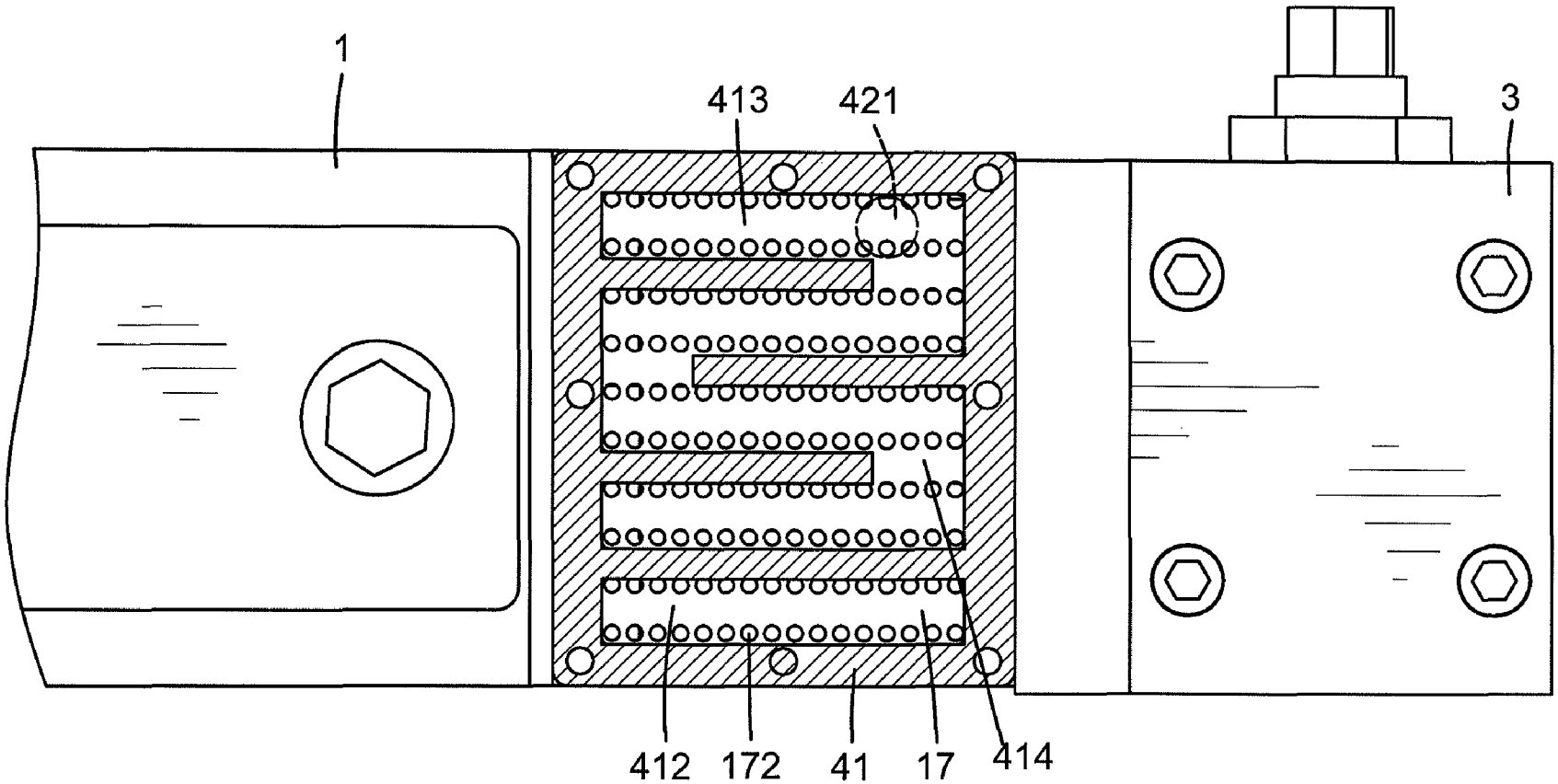
FIG. 8 is a cross sectional view taken along section line 8-8 of FIG. 5.
Figure 9:
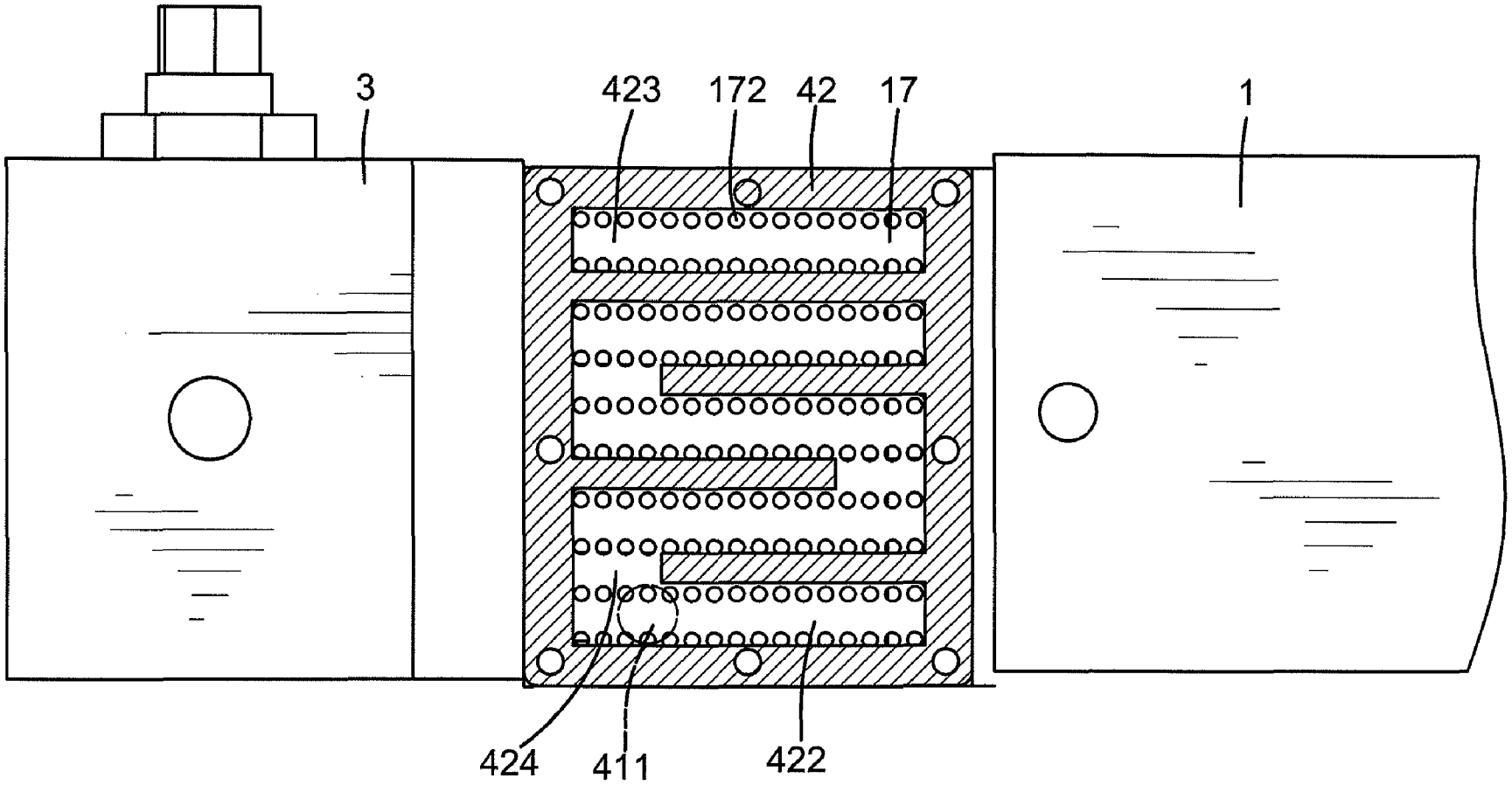
FIG. 9 is a cross sectional view taken along section line 9-9 of FIG. 5.

Cooling device 4 is provided on lower portion 17 of lubricant supply cup 1 and includes first and second cover plates 41 and 42 respectively mounted to first and second side walls 111 and 112 of lower portion 17 of lubricant supply cup 1. According to the preferred form shown, first cover plate 41 includes a coolant inlet 411 in fluid communication with one of cooling holes 172 for feeding a coolant (indicated by arrow 8 in FIG. 5) into cooling holes 172. Referring to FIGS. 5 and 8, first cover plate 41 further includes a first groove 412 in an inner surface thereof and in communication with coolant inlet 411. First cover plate 41 further includes a first continuous, zigzag groove 413 in the inner surface thereof and spaced from first groove 412. Referring to FIGS. 5 and 9, second cover plate 42 includes a coolant outlet 421 in fluid communication with one of cooling holes 172 allowing coolant 8 in cooling holes 172 to exit coolant outlet 421. Second cover plate 42 further includes a second groove 422 in an inner surface thereof and in communication with coolant outlet 421. Second cover plate 42 further includes a second continuous, zigzag groove 423 in the inner surface thereof and spaced from second groove 422. First and second grooves 412 and 422 respectively extend in a direction parallel to the longitudinal axis. First and second continuous, zigzag grooves 413 and 423 respectively include a plurality of bends 414, 424. Further, first groove 412 is opposite to and in communication with second continuous, zigzag groove 423 through a portion of cooling holes 172. First continuous, zigzag groove 413 of first cover plate 41 is opposite to and in communication with second continuous, zigzag groove 423 and second groove 422 of second cover plate 42 through another portion of cooling holes 172 (see FIG. 5). Thus, coolant 8 introduced into first cover plate 41 from coolant inlet 411 flows through cooling holes 172 via first groove 412, second continuous, zigzag groove 423, first continuous, zigzag groove 413 and second groove 422, and then exits coolant outlet 421 of second cover plate 42. During flow of coolant 8 through cooling holes 172, coolant 8 absorbs heat of and, thus, cools lubricant 6 in longitudinal holes 171 before lubricant 6 flows out of lower portion 17 of lubricant supply cup 1. Further, two washers 43 are respectively mounted between first cover plate 41 and first side wall 111 and between second cover plate 42 and second side wall 112. Each washer 43 includes a rectilinear groove 431 having a shape corresponding to that of one of first, second grooves 412, 422. Each washer 43 further includes a zigzag groove 432 having a shape corresponding to that of one of first, second continuous, zigzag grooves 413, 423.

Figure 3:
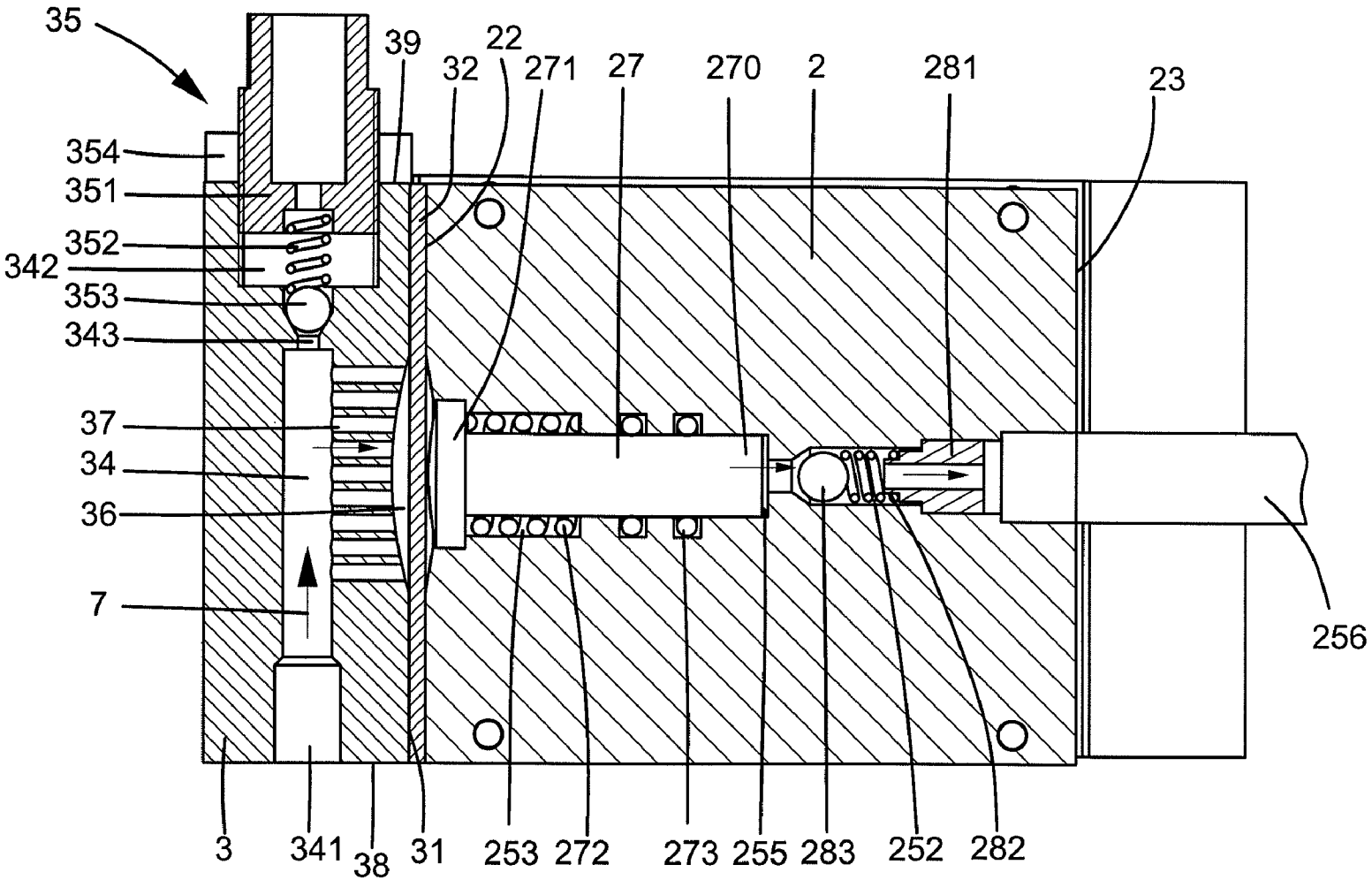
FIG. 3 is a cross sectional view taken along section line 3-3 of FIG. 1.
Figure 4:
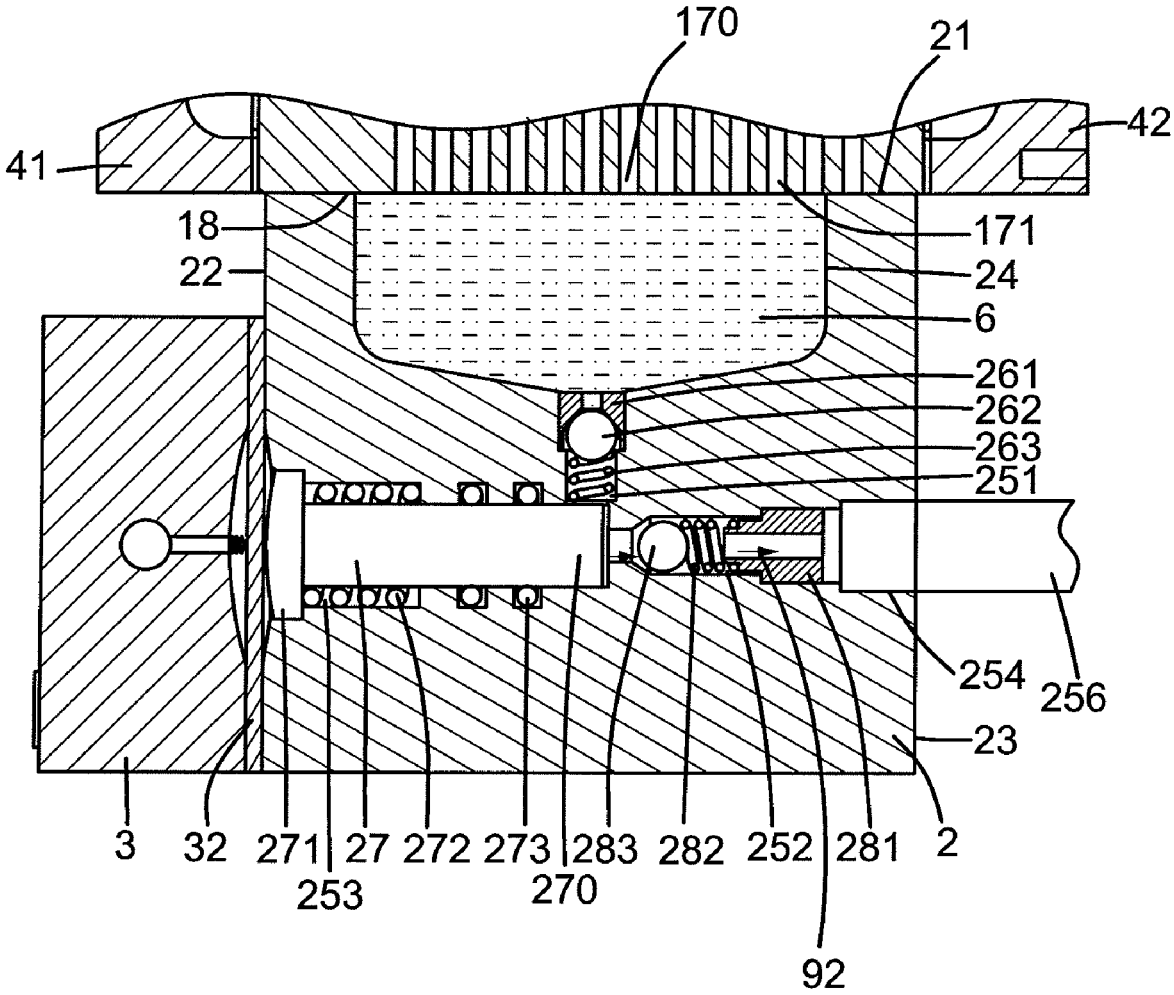
FIG. 4 shows a partially enlarged cross sectional view of FIG. 1.
Figure 6:
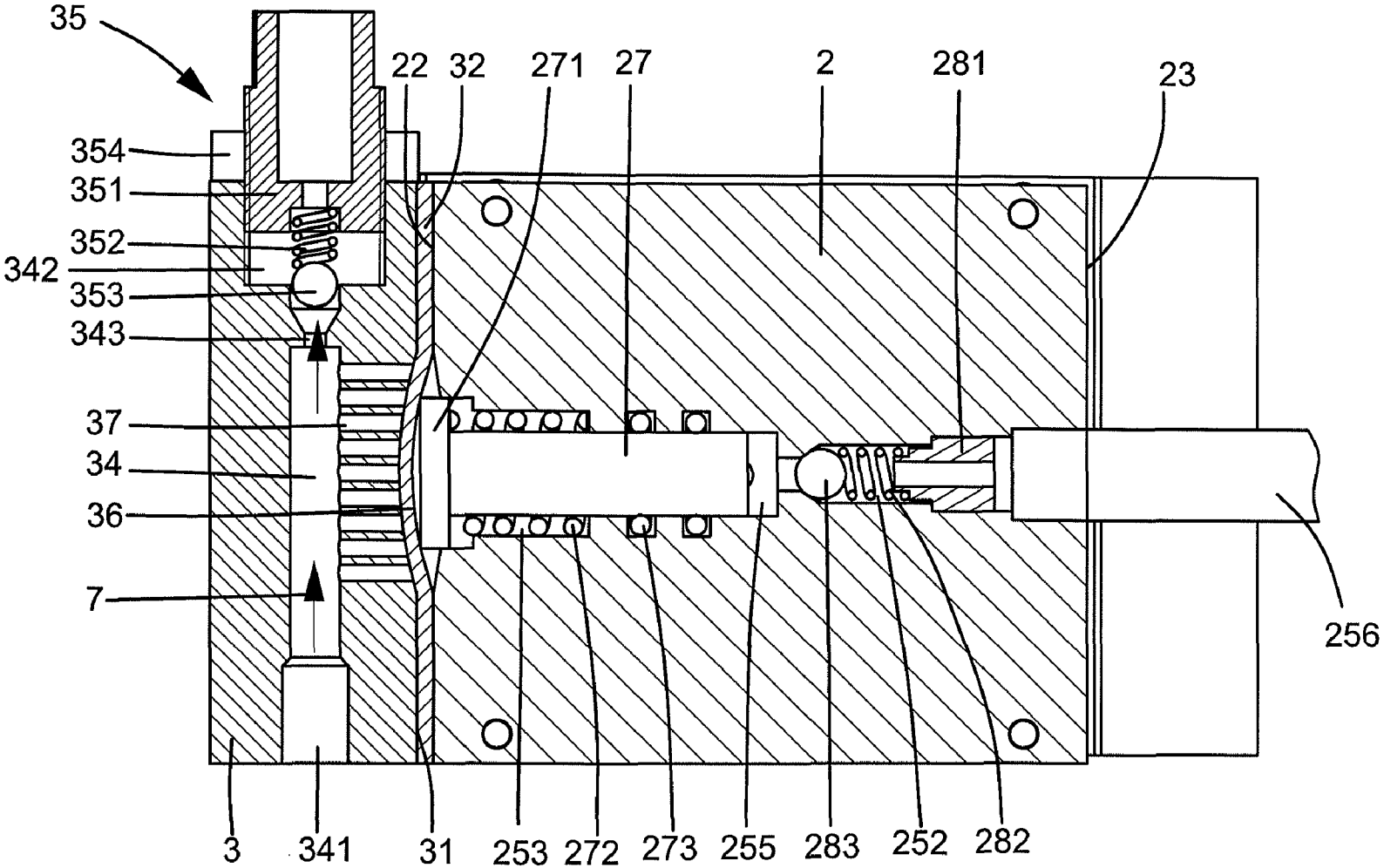
FIG. 6 shows a cross sectional view similar to FIG. 3, with a pressure relief valve opened and with a piston rod and a ball moved leftward.

Referring to FIGS. 3 and 4, when the pressure of pressurized fluid 7 introduced from pressure inlet 341 into pressure chamber 34 is smaller than a pressure value (i.e., the biasing force of spring 352) so that pressure relief valve 35 closes pressure outlet 342, pressurized fluid 7 applies a pressure to diaphragm 32 and first end 271 of piston rod 27 through fluid passage 37 of pump body 3 during closure of pressure outlet 342, moving piston rod 27 towards inner end 255 of pump chamber 253. After a period of time, the pressure of pressurized fluid 7 accumulated in pressure chamber 34 becomes greater than the biasing force of spring 352 to ball 353. Pressurized fluid 7 exits pressure outlet 342, and piston rod 27 moves towards first side face 22 of pump seat 2 by spring 272 (see FIGS. 6 and 7). Thus, by continuously introducing pressurized fluid 7 from pressure inlet 341 into pressure chamber 34, piston rod 27 is reciprocally moved in pump chamber 34. When piston rod 27 moves towards first side face 22 of pump seat 2, pump inlet 251 is opened to allow flow of lubricant 6 into inner end 255 of pump chamber 253 from recess 24 (see arrow 91 in FIG. 7), and pump outlet 252 is closed to prevent lubricant 6 from flowing from pump outlet 252 to inner end 255. On the other hand, when piston rod 27 moves towards inner end 255 of pump chamber 253 and, thus, pushes lubricant 6 in inner end 255 outward, pump inlet 251 is closed and pump outlet 252 is opened, allowing the supply of lubricant 6 from inner end 255 to rotary equipment 5 through pump outlet 252 and oil supply pipe 256 (see arrow 92 in FIG. 4). Thus, lubricant 6 in lubricant supply cup 1 can be successively supplied into rotary equipment 5 to lubricate bearings (not shown) of rotary equipment 5. Further, excessive lubricant 6 in rotary equipment 5 can return into oil chamber 11 of lubricant supply cup 1 through oil return pipe 16, thereby circulating lubricant 6 between lubricant supply cup 1 and rotary equipment 5. Furthermore, the heat exchange of lubricant 6 in longitudinal holes 171 and coolant 8 in cooling holes 172 can cool lubricant 6 before it is supplied to rotary equipment 5. Thus, the resultant lubrication effect of lubricant circulation system 10 is satisfactory.

Thus since the invention disclosed herein may be embodied in other specific forms without departing from the spirit or general characteristics thereof, the embodiment described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A lubricant circulation system comprising:

a lubricant supply cup including an oil chamber containing a lubricant, with the lubricant supply cup further including an oil return hole adapted to communicate the oil chamber with an oil return pipe of a rotary equipment for returning the lubricant from the rotary equipment into the oil chamber with the lubricant supply cup further including a lower portion having an oil supply outlet extending along a longitudinal axis of the lubricant supply cup;

a pump seat including an upper end engaged with the lower portion of the lubricant supply cup, with the pump seat further including a first side face and a second side face spaced from the first side face in a direction transverse to the longitudinal axis, with the pump seat further including a pump chamber extending from the first side face towards but spaced from the second side face and receiving a piston rod, with the pump chamber including an inner end in an interior of the pump seat, with a pump inlet being provided between the inner end of the pump chamber and the upper end of the pump seat and in communication with the oil supply outlet of the lubricant supply cup, with a pump outlet being provided between the inner end of the pump chamber and the second side face and adapted to be connected to an oil supply pipe of the rotary equipment for supplying the lubricant to the rotary equipment; and a pump body including a coupling surface engaged with the first side face of the pump seat, with the pump body further including a first side and a second side spaced from the first side and extending in a direction transverse to the coupling surface, with the pump body further including a pressure chamber extending from the first side to the second side and having a pressure inlet in the first side and a pressure outlet in the second side, with the pump body further including a pressure relief valve mounted in the pressure outlet for closing or opening the pressure outlet, and with a fluid passage being provided between the pressure chamber and the coupling surface of the pump body;

wherein the lubricant in the lubricant supply cup flows into the inner end of the pump chamber through the oil supply outlet of the lubricant supply cup and the pump inlet of the pump seat, and wherein a pressurized fluid introduced from the pressure inlet into the pressure chamber applies a pressure to the piston rod through the fluid passage of the pump body during closure of the pressure outlet and exits the pressure outlet when the pressure of pressurized fluid flow is greater than a pressure value so that the pressure relief valve opens the pressure outlet, reciprocating the piston rod in the pump chamber to successively supply the lubricant in the inner end of the pump chamber to the rotary equipment, with a diaphragm being provided between the coupling surface of the pump body and the first side face of the pump seat, with the oil supply outlet of the lower portion of the lubricant supply cup including a plurality of longitudinal holes each extending from a lower end face of the lubricant supply cup into the oil chamber along the longitudinal axis, and with the pump chamber extending in a direction perpendicular to the longitudinal axis, with the lubricant supply cup further including a first side wall and a second side wall spaced from the first side wall in a direction perpendicular to the longitudinal axis, with the lower portion of the lubricant supply cup including a plurality of cooling holes spaced from each other and each extending from the first side wall to the second side wall and not in communication with the longitudinal holes, with the lubricant circulation system further comprising a cooling device for cooling the lubricant, with the cooling device including first and second cover plates respectively mounted to the first and second side walls of the lubricant supply cup, with the first cover plate including a coolant inlet in fluid communication with one of the cooling holes for feeding a coolant into the cooling holes, and with the second cover plate including a coolant outlet in fluid communication with one of the cooling holes allowing the coolant in the cooling holes to exit the coolant outlet, with the first cover plate further including a first groove in an inner surface thereof and in communication with the coolant inlet, with the first cover plate further including a first continuous, zigzag groove in the inner surface thereof and spaced from the first groove, with the second cover plate further including a second groove in an inner surface thereof and in communication with the coolant outlet, with the second cover plate further including a second continuous, zigzag groove in the inner surface thereof and spaced from the second groove, with the first groove of the first cover plate being in communication with the second continuous, zigzag groove of the second cover plate through a portion of the cooling holes, and with the first continuous, zigzag groove of the first cover plate being in communication with the second continuous, zigzag groove and the second groove of the second cover plate through another portion of the cooling holes.

2. The lubricant circulation system as claimed in claim 1, with the pump inlet including a recess in the upper end of the pump seat for receiving the lubricant from the oil supply outlet of the lubricant supply cup, with a first check valve being mounted in the pump inlet for allowing flow of the lubricant from the recess to the inner end of the pump chamber and for preventing the lubricant from flowing from the inner end to the recess, and with a second check valve being mounted in the pump outlet for allowing flow of the lubricant from the inner end of the pump chamber to the pump outlet and for preventing the lubricant from flowing from the pump outlet to the inner end of the pump chamber.

3. The lubricant circulation system as claimed in claim 1, with the piston rod including a first end having a piston head and adjacent to the first side face of the pump seat, with the piston rod further including a second end adjacent to the inner end of the pump chamber, and with a spring being mounted in the pump chamber to bias the piston rod towards the first side face of the pump seat.

4. The lubricant circulation system as claimed in claim 3, with the fluid passage including a recessed portion formed in the coupling surface of the pump body and facing the first end of the piston rod, with the diaphragm being flexible between the recessed portion and the first end of the piston rod, and with the fluid passage further including a plurality of holes spaced from each other in a direction perpendicular to the coupling surface and extending between the pressure chamber and the recessed portion.

* * * * *